US007216742B2

(12) United States Patent
Spengler

(10) Patent No.: US 7,216,742 B2
(45) Date of Patent: May 15, 2007

(54) LADDER STABILIZERS

(76) Inventor: Robert G. Spengler, 81 Nashua Rd., N. Billerica, MA (US) 01862

( * ) Notice: Subject to any disclaimer, the term of this patent is extended or adjusted under 35 U.S.C. 154(b) by 0 days.

(21) Appl. No.: 10/345,068

(22) Filed: Jan. 15, 2003

(65) Prior Publication Data

US 2004/0134714 A1 Jul. 15, 2004

(51) Int. Cl.
*E06C 1/00* (2006.01)
*E06C 7/00* (2006.01)

(52) U.S. Cl. ..... 182/172

(58) Field of Classification Search ..... 182/172, 182/107, 108
See application file for complete search history.

(56) References Cited

U.S. PATENT DOCUMENTS

| | | | | | |
|---|---|---|---|---|---|
| 554,695 | A | * | 2/1896 | Hood | 182/116 |
| 979,821 | A | * | 12/1910 | Brasington | 182/205 |
| 1,134,491 | A | * | 4/1915 | Savage | 182/172 |
| 1,314,719 | A | | 9/1919 | Townsend | |
| 2,008,582 | A | * | 7/1935 | Fredriksen | 182/172 |
| 2,458,076 | A | * | 1/1949 | Houston | 182/205 |
| 3,508,628 | A | * | 4/1970 | Conrad | 182/172 |
| 3,891,054 | A | | 6/1975 | Larson | 182/107 |
| 4,147,231 | A | | 4/1979 | Chantler | 182/172 |
| 4,244,446 | A | * | 1/1981 | Mair | 182/172 |
| 4,519,477 | A | | 5/1985 | Ralston | 182/172 |
| 4,520,725 | A | * | 6/1985 | Haug | 101/91 |
| 4,641,729 | A | | 2/1987 | Beck et al. | |
| 4,798,263 | A | | 1/1989 | Harvey | 182/107 |
| 4,964,488 | A | | 10/1990 | Stewart | 182/172 |
| 5,341,899 | A | * | 8/1994 | Casamento | 182/205 |
| 5,868,222 | A | | 2/1999 | Charbonneau | 182/200 |

FOREIGN PATENT DOCUMENTS

| | | | |
|---|---|---|---|
| GB | 2146688 | A | 4/1985 |
| GB | 2146688 | A * | 4/1985 |

* cited by examiner

*Primary Examiner*—Alvin Chin-Shue
(74) *Attorney, Agent, or Firm*—John J. Pearson, Jr., Esq.; Walter F. Dawson, Esq.; Pearson & Pearson, LLP.

(57) ABSTRACT

A step ladder stabilizer for mounting behind the front step portion and having two adjusting legs which adjust as a slide lock moves vertically within a slot attached to the rear of the ladder steps. When not in use, the ladder stabilizer closes flush against the back of the ladder steps. An alternate embodiment includes a ladder stabilizer for an extension ladder comprising an extending leg and a stabilizer arm with the top of the extending leg attaching to a slide lock that slides along a channel mounted on the side of the ladder. Bolts passing through expansion inserts hold the channel onto each side of the ladder.

10 Claims, 10 Drawing Sheets

LADDER STABILIZERS

BACKGROUND OF THE INVENTION

1. Field of the Invention

The present invention relates generally to ladders and in particular to ladder stabilizers which are attached to a ladder and provide safety by reducing the possibility of slipping or tipping.

2. Description of Related Art

Ladders are known to be unstable and often require the assistance of a second person for steadying the ladder when a first person has climbed the ladder. However, another person is not always available when a ladder has to be used. There have been many devices made for stabilizing a ladder, and yet they do not solve the problems of being adjustable to all site conditions, convenient to use, easily installed on the ladder, compromising the integrity of the ladder, interfering with the use of the ladder, retractable and out of the way for storage, and providing stabilization when one side of the ladder is close to a wall.

U.S. Pat. No. 3,891,054 issued to Clayton E. Larson in 1975 discloses a step ladder stabilized by channel members which are fixed on each side of the lowest rung of the ladder and have an extendable member. Braces are provided at the upper rungs to provide rigidity and resistance against sway. However, it is not adjustable to all site conditions and adds very little stabilization to the ladder.

U.S. Pat. No. 4,964,488 issued to John V. Stewart on Oct. 23, 1990 discloses a step ladder stabilizer for a step ladder comprising a brace hinged to a ladder rail and an arm hinged to the rail at a lower position trussing the brace. The stabilizers on each side of the ladder fold against the front of the ladder. However, this ladder stabilizer is not adjustable to all site conditions and it interferes with the use of the ladder when not in use.

U.S. Pat. No. 5,868,222, issued to Francois Charbonneau on Feb. 9, 1999 discloses an extension ladder having a telescopic tube mounted to each side of the ladder's lower section and a lateral brace to support the telescopic tube extending away from each side of the ladder. However, the telescopic tubes bolt to the ladder which may compromise the integrity of the ladder, it is not easily installed on the ladder, and it is cumbersome and inconvenient to use. Also, it has removable pins and clips which are easily lost.

U.S. Pat. No. 4,147,231, issued to Douglas A. Chantler et al. on Apr. 3, 1979 discloses a ladder stabilizing device connected on the outer sides of the side pieces of the ladder. The device comprises outwardly extensible legs having an upper leg part connected to a slide plate on the side of the ladder which adjusts up and down. A lower leg support extends from the side of the ladder near the bottom and extends out to the upper leg part at its lower end. The upper and lower leg parts lie flat against the side of the ladder for storage when the ladder is not in use. However, this device lifts the ladder legs off the surface which eliminates the stability which otherwise would be provided by these legs. Also, this device is cumbersome and inconvenient to use.

U.S. Pat. No. 4,519,477, issued to Robert Ralston on May 28, 1984 discloses an adjustable stabilizer device for an extension ladder with hollow rungs comprising two stabilizing elements, an upper bracket and a lower bracket. Each stabilizing element connects to an upper right angle bracket which connects to a side wall bracket. The stabilizing elements are connected to each other by rods which extend through the hollow rungs of the ladder and attach to the side wall brackets. When the ladder is not in use the stabilizer elements are retained flush against the sides of the ladder for storage. However, this device is not adjustable to all site condition, is cumbersome and inconvenient to use, and has removable pins and clips which can be easily lost.

SUMMARY OF THE INVENTION

Accordingly, it is therefore an object of this invention to provide a step ladder stabilizer which attaches to the rear of the front step portions of the ladder and is adjustable vertically whereby the stabilizer legs adjust horizontally toward or away from the front step section of the ladder.

It is another object of the invention to provide a step ladder stabilizer which closes flush against the step ladder when not in use.

It is a further object of this invention to provide a ladder stabilizer for an extension ladder, having an extending rod and a stabilizing arm, that mounts to each side of the ladder whereby the upper portion of the rod slides up and down for variations in the ground.

It is another object of this invention to provide an extension ladder stabilizer that closes flush against the sides of the ladder when not in use.

These and other objects are accomplished by a stabilizer for a step ladder comprising a channel having a slot along a side of the channel, means for attaching the channel to a front step portion of the step ladder, means attached to the channel for mounting a pair of legs wherein the legs extend or retract in accordance with the movement of the mounting means along the slot of the channel, means attached between the pair of legs for fixing the legs in a spaced-apart position and for releasing the legs to enable the pair of legs to be retracted adjacent to the channel, and means for securing each leg of the pair of legs to the front step portion of the step ladder. The attaching means comprises a slide lock bracket adapted to move along the slot of the channel. The legs securing means comprises a first arm attached between a first one of the pair of legs and the front step portion of the step ladder, and a second arm attached between a second one of the pair of legs and the front step portion of the step ladder.

The objects are further accomplished by a stabilizer for a step ladder comprising a channel having an upper bracket and a lower bracket for mounting the channel to a front step portion of the step ladder, a slide lock bracket adapted to slide along the channel and be locked at a preferred position, a first leg of the stabilizer attached to a first side of the sliding lock bracket, the first leg extending downward away from the channel, a second leg of the stabilizer attached to a second side of the sliding lock bracket, the second leg extending downward away from the channel, a spreader bar attached between the first leg and the second leg, a first arm of the stabilizer having a first end attached to the first leg and a second end adapted to attach to the front step portion of the step ladder, and a second arm having a first end attached to the second leg and a second end adapted to attach to the front step portion of the step ladder. The spreader bar comprises means for folding-up the spreader bar. The slide lock bracket comprises means for securing the slide lock bracket along the channel at the preferred position to stabilize the step ladder. Each of the first leg and the second leg comprises an extension leg which extends from the first leg and the second leg to stabilize the step ladder. The stabilizer closes-up against the channel when the slide lock bracket is raised along the channel.

The objects are further accomplished by a step ladder having a front step section and a rear prop section, the rear prop section being movably attached to a top portion of the step ladder adjacent to the front step section, a step ladder stabilizer, attached to the front step section and extending between the front step section and the rear prop section to provide stabilization, comprising a channel having an upper bracket and a lower bracket for mounting to the front step section of the step ladder, the channel having an opening running the length of the channel, a slide lock bracket adapted to slide along the opening of the channel and be locked at a preferred position, a first leg attached to a first side of the slide lock bracket, the first leg extending downward away from the channel, a second leg attached to a second side of the slide lock bracket, the second leg extending downward away from the channel, a spreader bar attached between the first leg and the second leg, a first arm having a first end attached to the first leg and a second end adapted to attach to the front section of the step ladder, and a second arm having a first end attached to the second leg and a second end adapted to attach to the front step section of the step ladder. The spreader bar comprises means for folding-up the spreader bar. The slide lock bracket comprises means for securing the slide lock bracket along the channel at the preferred position to stabilize the step ladder. The step ladder stabilizer closes-up against the front step portion of the step ladder when the slide lock bracket is raised along the channel.

The objects are further accomplished by an extension ladder stabilizer comprising a channel, capable of being attached to a side of a ladder, which comprises an opening on an outer side running the length of the channel, a slide lock bracket attached to the channel and adapted to slide along the opening of the channel and be locked at a preferred position, a hinged connecting plate attached to a lower portion of the slide lock bracket, having means for attaching a first section of the hinged connecting plate to the slide lock bracket, an extending leg having a first end attached to a second section of the hinged connecting plate enabling the leg to rotate about the attaching means, and a foldable arm having a first end attached to a lower end portion of the channel and a second end attached to a predetermined location on the extending leg. The slide lock bracket comprises a lever for securing the slide lock bracket along the channel at the preferred position for optimum stabilization of the ladder. The extending leg comprises an extension section which extends from the extending leg for stabilizing the ladder. The foldable arm comprises means for locking the arm into a fixed position for stabilizing the ladder. A U-shaped guard is positioned between a side of the ladder and the channel to protect the extending leg when closed and adjacent to the ladder.

The objects are further accomplished by an extension ladder comprising a plurality of steps positioned between a first side and a second side of the ladder, each one of the plurality of steps having a first expansion insert placed into a first side of the ladder and into each of the plurality of steps and a second expansion insert placed into a second side of the ladder and into each of the plurality of steps, a first ladder stabilizer attached to the first side of the extension ladder, a second ladder stabilizer attached to the second side of the extension ladder, the first ladder stabilizer and the second ladder stabilizer each comprising a channel attached to the side of the ladder having an opening on an outer side running the length of the channel, a slide lock bracket attached to the channel and adapted to slide along the opening of the channel or to be locked at a preferred position, a hinged connecting plate having a first section attached to a lower portion of the slide lock bracket, an extending leg having a first end attached to a second section of the hinged connecting plate enabling a second end of the extending leg to be moved toward or away from the side of the ladder, and a foldable arm having a first end attached to a lower end of the channel and a second end attached to a predetermined location on the extending leg. The slide lock bracket comprises means for securing the slide lock bracket along the channel at the preferred position for optimum stabilization of the ladder. The extending leg comprises an extension section which extends from the extending leg for stabilizing the ladder. The foldable arm comprises means for locking the arm into a fixed position for stabilizing the ladder. A first U-shaped guard is positioned between a first side of the extension ladder and the channel of the first ladder stabilizer, and a second U-shaped guard is positioned between a second side of the ladder and the channel of the second ladder stabilizer.

The objects are further accomplished by a lever lock assembly comprising a lever having means on an end of a right angled portion of the lever for griping a first surface when the lever is in a closed position, a frame for mounting the lever lock assembly to a second surface, the frame having an opening for the end of the right angled portion of the lever to enter, means for securing the right angled lever within a center portion of the frame to enable the lever to rotate about the securing means with the right angled portion of the lever protruding through the opening in the frame when the lever is in the closed position, and a U-shaped spring, one end attached to the frame below a handle portion of the lever and the other end positioned against an underside of the handle portion of the lever. The griping means comprises a plurality of teeth on the end of a right angled portion of the lever. The U-shaped spring comprises a U-shaped leaf spring.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
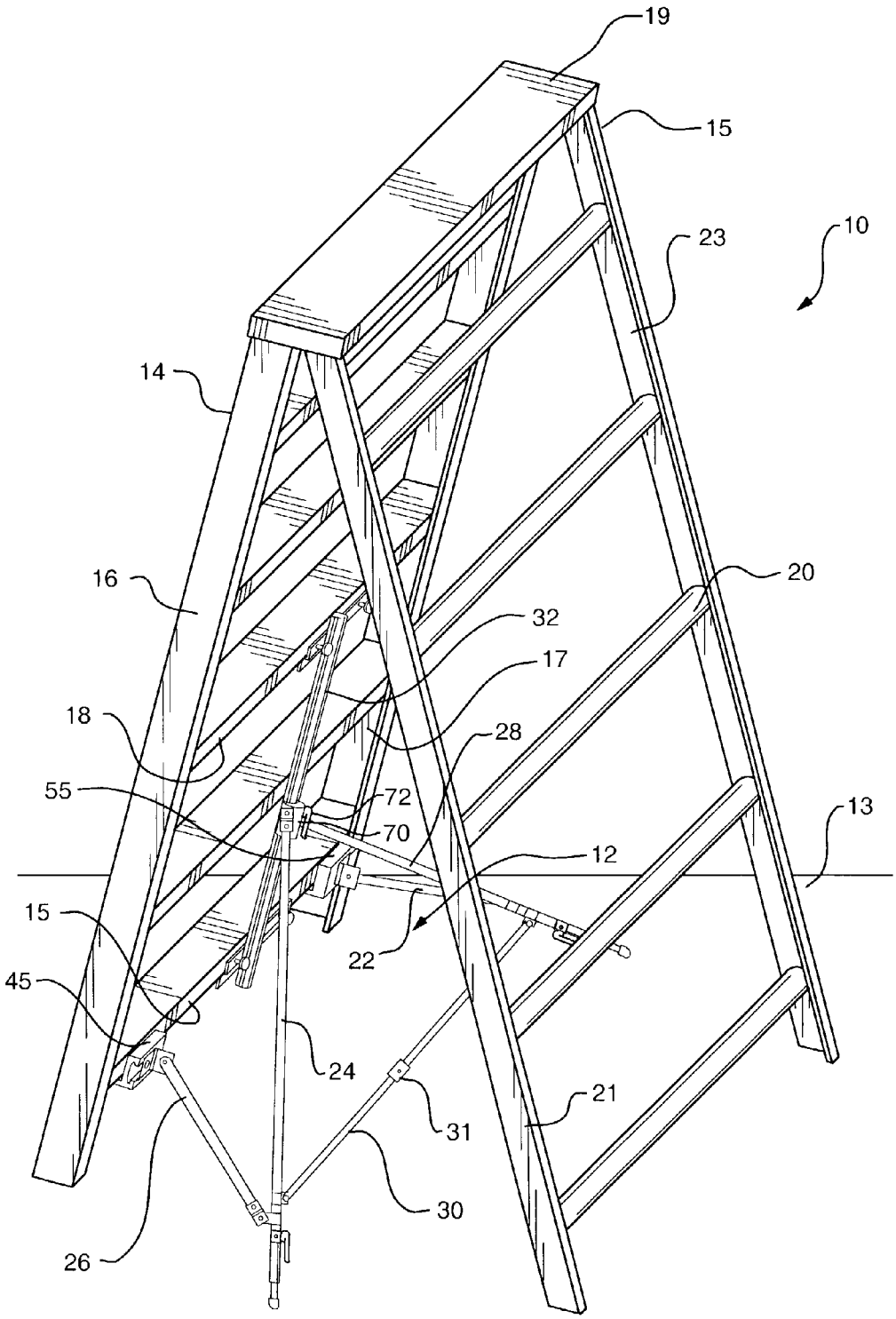
FIG. 1 is a perspective view of a step ladder having a step ladder stabilizer attached thereto.

Referring to FIG. 1, a perspective view of a step ladder 10 is shown comprising a ladder stabilizer 12 attached thereto. The step ladder 10 comprises a front step section 14 and a rear prop section 15. The front step section 14 comprises side rails 16, 17 and a plurality of steps 18 between the side rails 16, 17. The rear prop section 15 supports the front step section 14 and has secondary side rails 21, 23 with a plurality of bars 20 between such rails 21, 23 for strength and inherent stability of the step ladder 10. The bars 20 are generally not of sufficient strength for climbing. With the ladder stabilizer 12 attached to the step ladder 10, the ladder stabilizer 12 may be closed-up to rest adjacent to the front step section 14 and the rear prop section 15 closed against the stabilizer 12 and the front step section 14.

Figure 2:
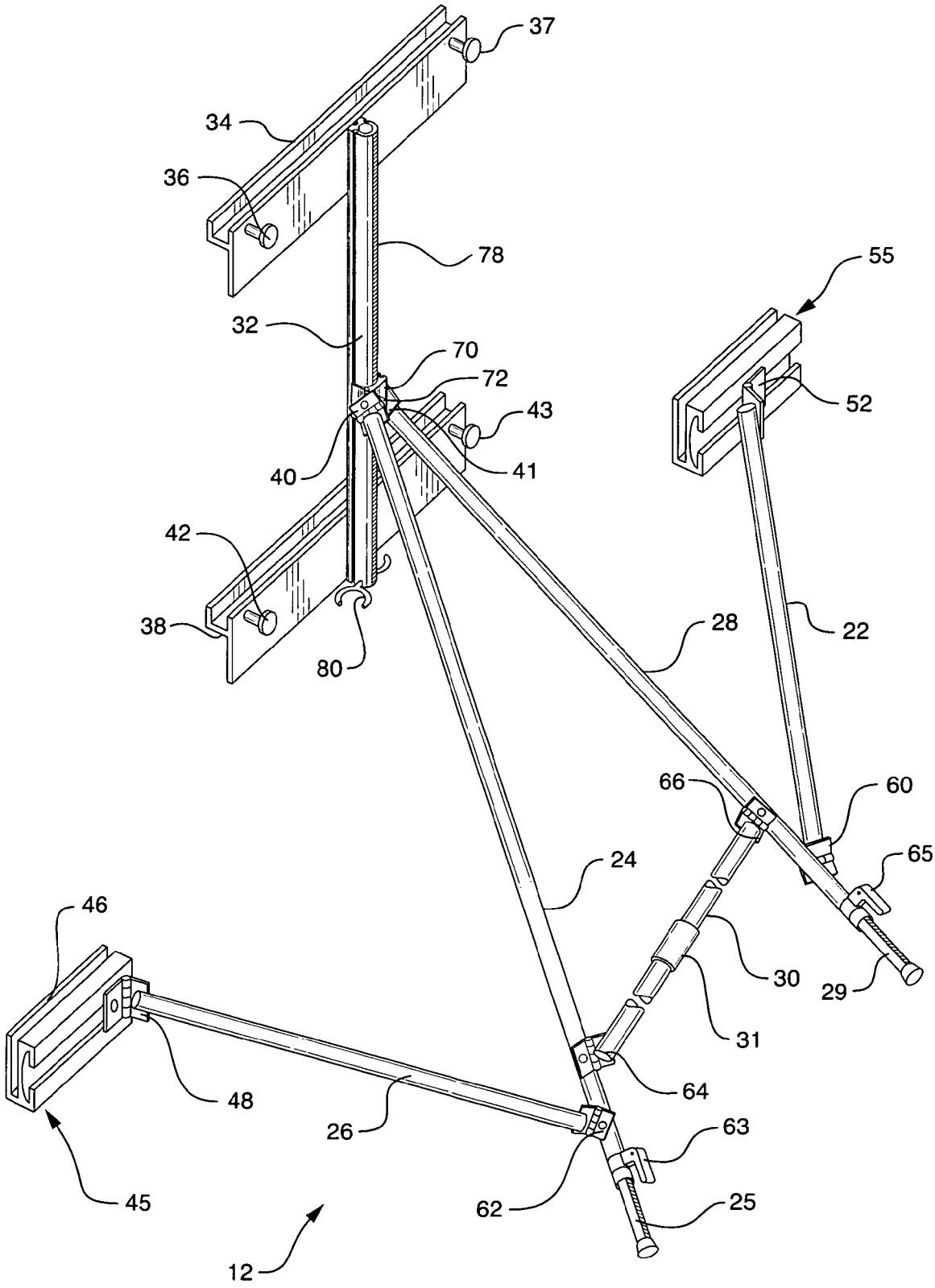
FIG. 2 is a perspective view of the step ladder stabilizer in the open position.

Referring to FIG. 1 and FIG. 2, FIG. 2 is a perspective view of the ladder stabilizer 12 according to the present invention for mounting on step ladder 10. The ladder stabilizer 12 comprises a channel 32 having an upper bracket 34 and a lower bracket 38 for attaching the stabilizer 12 to a back portion of steps 15, 18 of the front step section 14.

Figure 3:
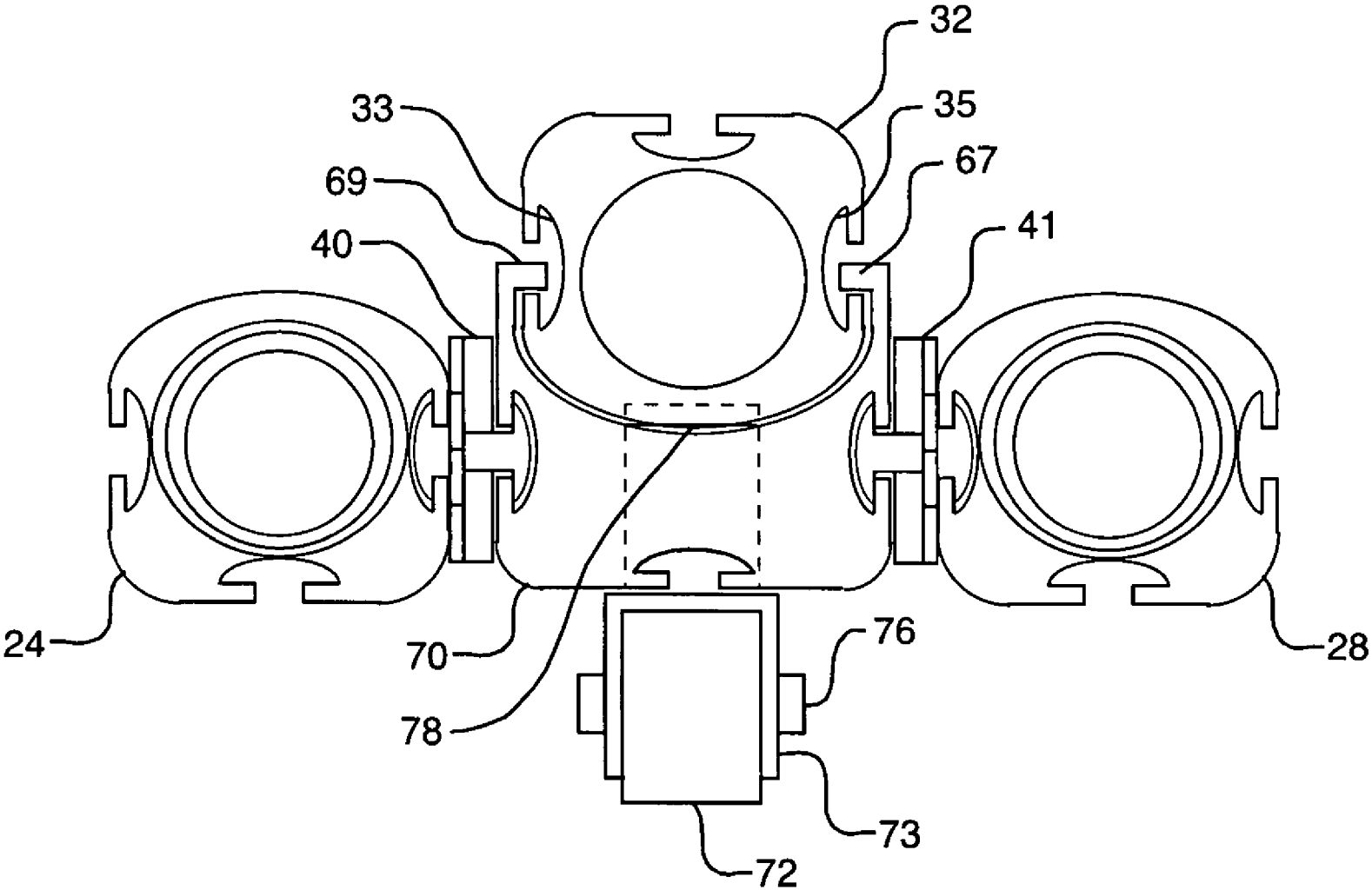
FIG. 3 is a top view of a channel with sliding bracket and stabilizer legs attached to each side of the sliding bracket.

Screws 36, 37 are provided in upper bracket 34 for securing the upper bracket 34 to an upper step 18, and screws 42, 43 are provided in lower bracket 38 for securing the lower bracket 38 to a lower step 15. Other securing means such as bolts are equally applicable in place of the screws 36, 37, 42 and 43. A sliding bracket 70 is positioned on channel 32 to slide up and down channel 32, and it is secured at a desirable position along the channel 32 by a slide lock 72 (FIG. 3). A first stabilizer leg 24 attaches via a hinged connecting plate 40 to the sliding bracket 70, and a second stabilizer leg 28 attaches to the other side of the sliding bracket 70 via hinged connecting bracket 41. The stabilizer legs 24, 28 extend downward toward a support surface 13 away from the front step section 14 of the step ladder 10 to provide stabilization for the step ladder 10. A spreader bar 30 connects between stabilizer leg 24 and stabilizer leg 28. Midway along spreader bar 30 is a release bracket 31 to allow the spreader bar 30 to fold up when slide lock 72 is raised along channel 32 in order to close-up the step ladder stabilizer 12.

Still referring to FIG. 2, a first arm 26 extends from the stabilizer leg 24, below a first end 64 of the spreader bar 30, to a clamp 45. The first arm 26 connects to the stabilizer leg 24 by means of a hinged connecting plate 62 and the other end of the arm 26 comprises a hinged connecting plate 48 which attaches to the clamp 45. Clamp 45 attaches the arm 26 to a step such as step 15 of ladder 10. A second arm 22 extends from the stabilizer leg 28, just below the second end 66 of the spreader bar 30, to a clamp 55. The second arm 22 connects to the stabilizer leg 28 by means of a hinged connecting plate 60 and the other end of the arm 22 comprises a hinged connecting plate 52 connected thereto which attaches to the clamp 55. Each of the hinged connecting plates 60, 62 is fixed at one end with a bolt and net and the other end comprises a bolt with a nylon or plastic washer and a cap nut to enable one sectin of the hinge to rotate around the bolt.

Referring to FIG. 3, a top view of a channel 32 with the sliding bracket 70 is shown having hinged connecting plates 40, 41 at the ends of the stabilizer legs 24, 28 respectively connected to sliding bracket 70. The sliding bracket 70 comprises right angle arms 69, 67 which protrude into slots 33, 35 of channel 32 respectively and keep the bracket 70 secured to channel 32 as it slides along channel 32 while being adjusted. A lever 72 rotates about a pin 76 and when closed as shown in FIG. 3, secures the sliding bracket 70 to a position along channel 32.

Figure 4:
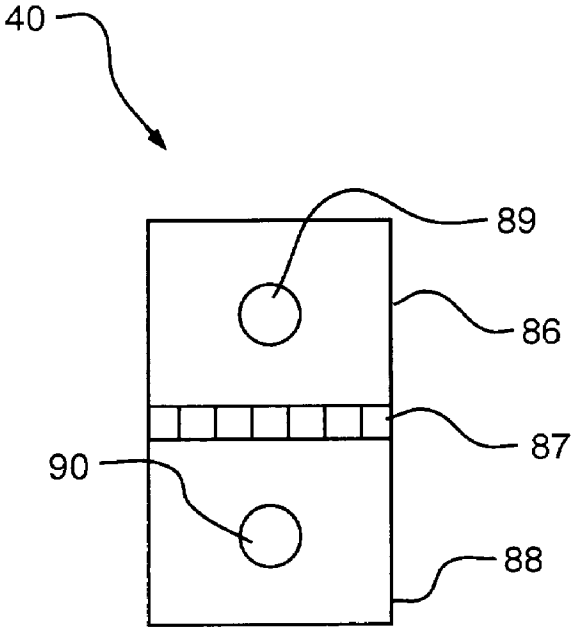
FIG. 4 is a front elevational view of a hinged connecting plate.

Referring to FIG. 4, a front elevational view of the hinged connecting plate 40 is shown comprising a first section 86 having a center hole 89 and a second section 88 comprising a center hole 90. The first section 86 and the second section 88 are connected together by a hinge 87. The hinge connecting plate 40 and similar hinge connecting plates 41, 48, 52, 60, 62, 64 and 66 are used in the ladder stabilizer 12 at connection points to facilitate movement in three directions when the opening and closing the ladder stabilizer 12 attached to the step ladder 10. Typically, one section 86 of the hinged connecting plate 40 is connected firmly with a bolt and a nut through hole 89, and the other section 88 has a bolt extending through hole 90 with a nylon or plastic washer and a cap nut to enable that section of the hinged connecting plate 40 to rotate around the bolt.

Figure 5:
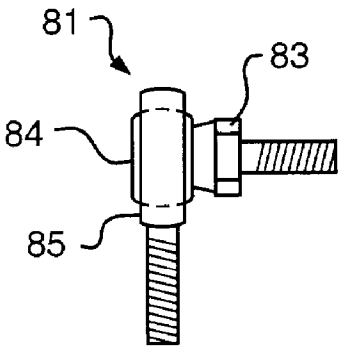
FIG. 5 is a side elevational view of a ball joint.

Referring now to FIG. 5, a side elevational view of a ball joint 81 is shown. The ball joint may be used as an alternate embodiment for the hinged connecting plates 40, 41, 48, 52, 60, 62, 64, 66. A rotating portion 85 of the ball joint 81 comprises a threaded bolt 83 extending from a side and the rotating portion 85 rotates about the ball 84.

Figure 6:
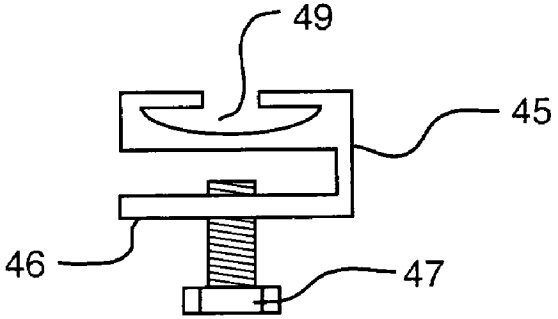
FIG. 6 is a side elevational view of a ladder step clamp.

Referring now to FIG. 2 and FIG. 6, FIG. 6 shows a side elevational view of the ladder step clamp 45, 55. It comprises a slot 49 for receiving the head of a bolt which is used to secure, for example, the hinged connecting plate 40 to the clamp 45. A U-shaped opening 46 is provided for inserting a bottom edge of the ladder steps 15, 18 when the ladder step clamp 45, 55 is secured to the ladder steps 15, 18 by a bolt 47.

Figure 7:
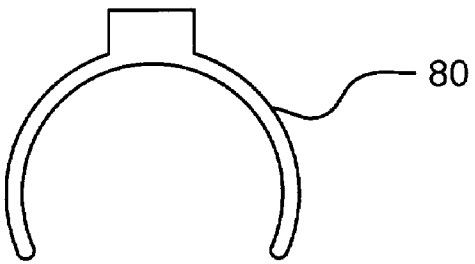
FIG. 7 is a plan view of a leg side clip.
Figure 10:
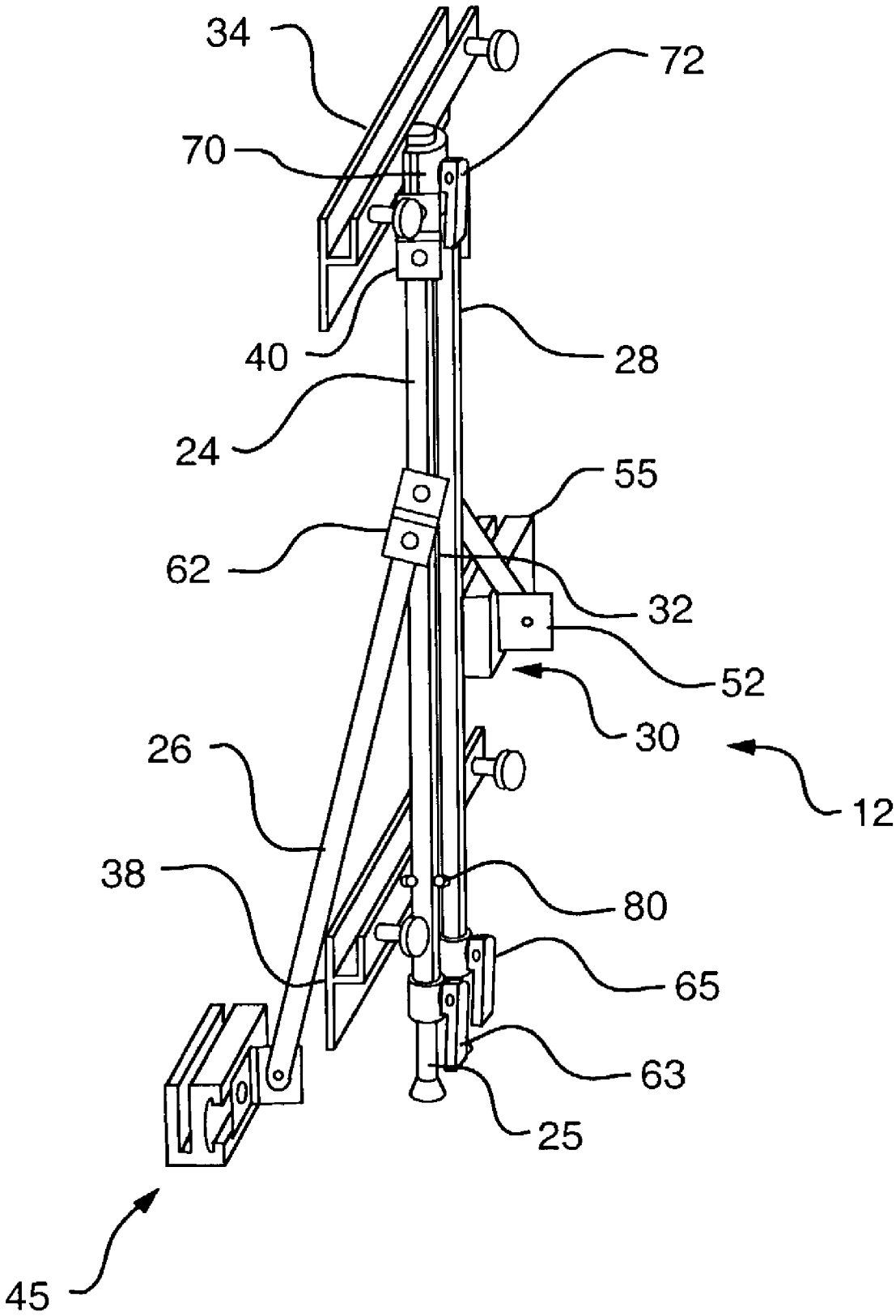
FIG. 10 is a perspective view of the step ladder stabilizer of FIG. 2 in the closed position.

Referring to FIG. 2 and FIG. 7, FIG. 7 is a plan view of a clip 80 for retaining the stabilizer legs 24, 28 adjacent to channel 32 when the ladder stabilizer is in the closed position as shown in FIG. 10. Clips 80 are secured to opposite sides of channel 32 as shown in FIG. 2.

Figure 8:
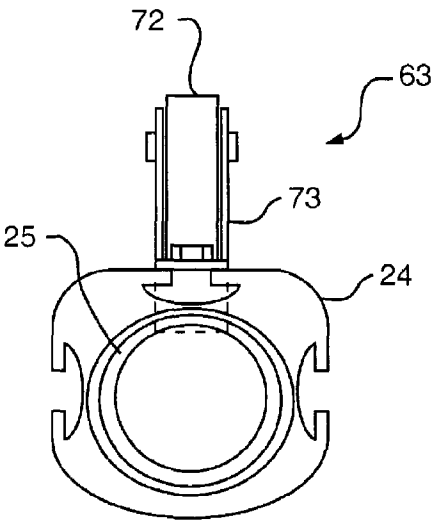
FIG. 8 is a top view of a leg of the step ladder stabilizer showing side slots for receiving bolt heads.

Referring now to FIG. 8, a top view is shown of the leg 24 of the step ladder stabilizer 12 including an inner extension leg 25 and a lock lever assembly 71 mounted on the outside of the stabilizer leg 24 for securing the extension leg 25 at a particular position along the stabilizer leg 24. The stabilizer leg 28 is similarly constructed.

Figure 9:
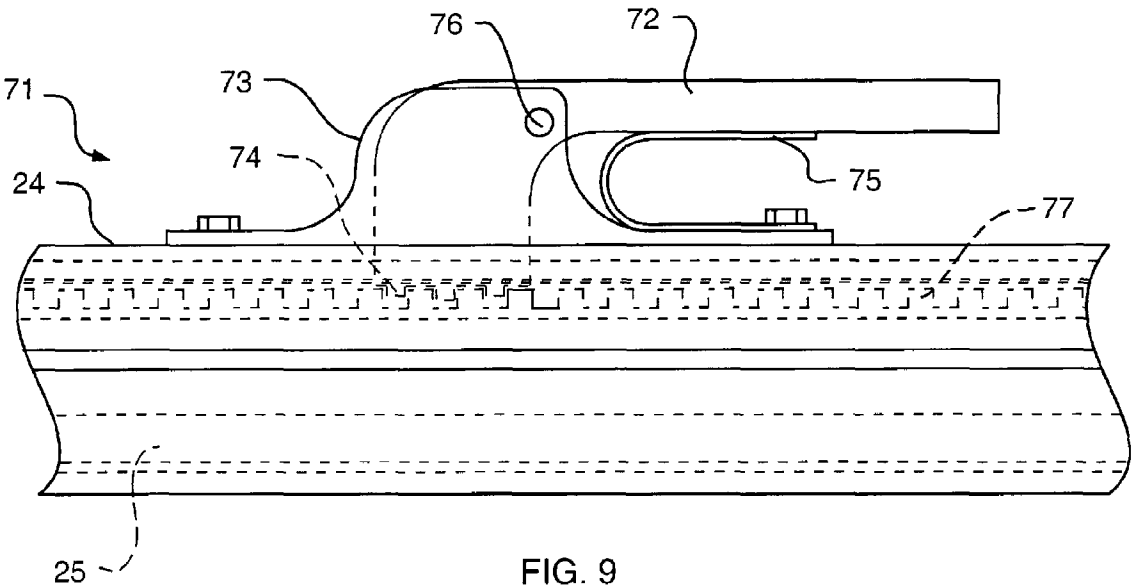
FIG. 9 is a side elevational view of a portion of the leg of the step ladder stabilizer having a lock lever.

Referring to FIG. 8 and FIG. 9, FIG. 9 is a side elevational view of a portion of the leg 24 of the step ladder stabilizer comprising the lever lock assembly 71. The lever lock assembly 71 comprises an outer frame 73 having a right-angled lever 72 positioned within the side walls of the frame 73 and rotating about a cylindrical pin 76. A U-shaped leaf spring 75 has a first portion attached to a base of the frame under the lever 72 and a second portion resting against the under side of the lever 72. The end of the right-angled lever 72 comprises rectangular teeth 74 as shown in FIG. 9 having a height of approximately one-eighth inch which mesh with gear track rectanglular teeth 77 having a height of approximately one-eighth inch and located along a portion of the side of the inner extension leg 25. The leaf spring 75 keeps the right-angled lever teeth 74 meshed with the teeth 77 so that the lever lock assembly 71 is self-locking, and only unlocks when the lever 72 is pushed inward to the gear track teeth 77. An opening is provided in the side of the stabilizer leg 24 for the right-angled lever 72 to enter. The ends of the lever lock frame 73 are secured to the side of the stabilizer leg 24 by bolts and nuts or rivets.

Referring to FIG. 10, a perspective view of the step ladder stabilizer 12 of FIG. 2 removed from the step ladder 10 is shown in the closed position. In order to achieve the closed position removed from the step ladder 10, the upper bracket 34 and the lower bracket 38 are removed from steps 18 and 15 respectively, the clamp 45 at the end of the first arm 26 is removed from step 15, and the clamp 55 at the end of the second arm 22 is also removed from step 15. Then the release bracket 31 of the spreader bar 30 is actuated and the spreader bar 30 folds-up which causes the stabilizer legs 24, 28 to move toward each other. Next, the lever 72 of the slide lock 70 is loosened, and the slide lock 70 is moved toward the top of the channel 32 causing the two stabilizer legs 24, 28 to close parallel to the vertical channel 32 and snap into clips 80. The arms 22, 26 rest along the sides of stabilizer legs 24, 28.

The preferred embodiment of the step ladder stabilizer shown in FIG. 2 comprises elements embodied with aluminum having the following dimensions, but one of ordinary skill in the art will recognize that there are may variations to such dimensions that will work equally well. In one embodiment, the channel 32 is 1½ inches wide×½ inch deep×30 inches long with a slot opening of ¾ inch wide. The stabilizer legs 24, 28 are 55 inches long extendable to 70 inches and are 1 inch in diameter. The spreader bar 30 is 38 inches long. The arms 22, 26 are 1 inch in diameter and 20 inches long.

Figure 11:
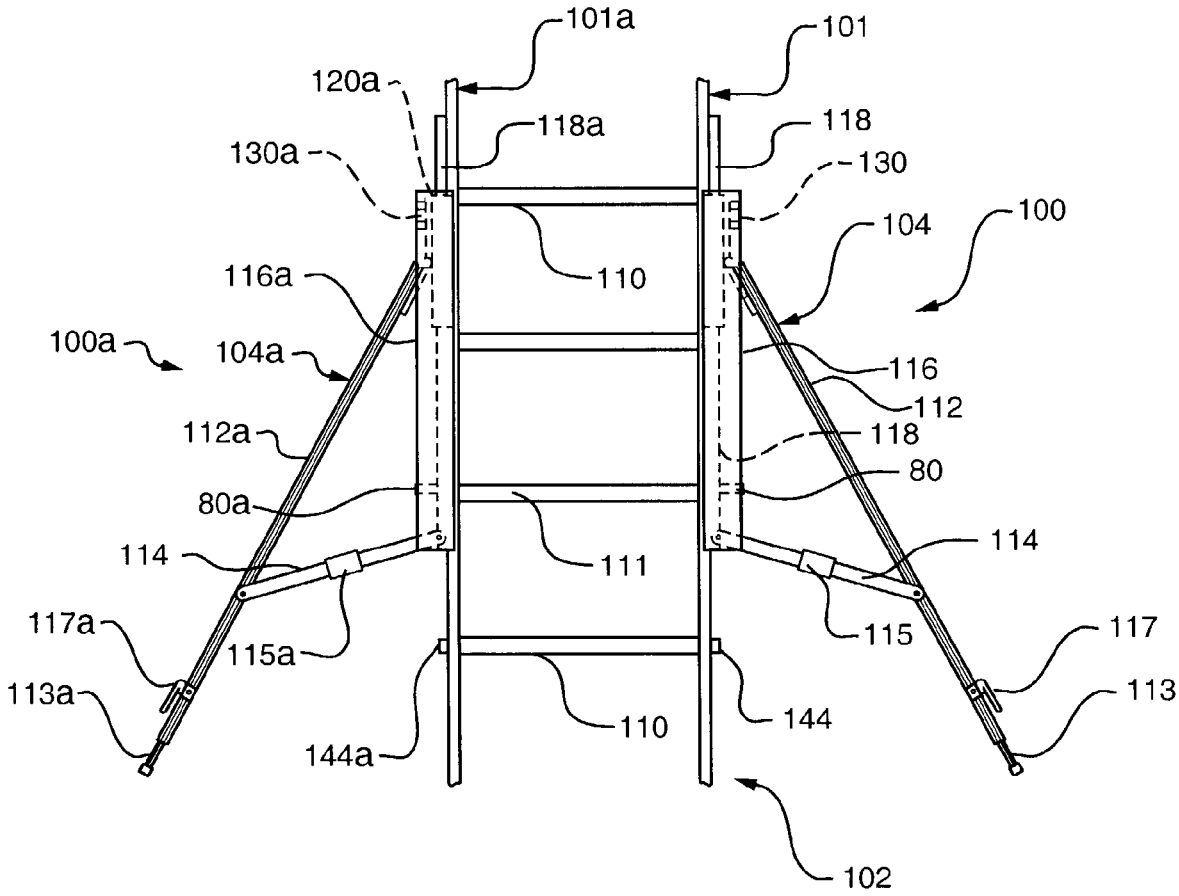
FIG. 11 is a front elevational view of an alternate embodiment of a ladder stabilizer for an extension ladder.
Figure 12:
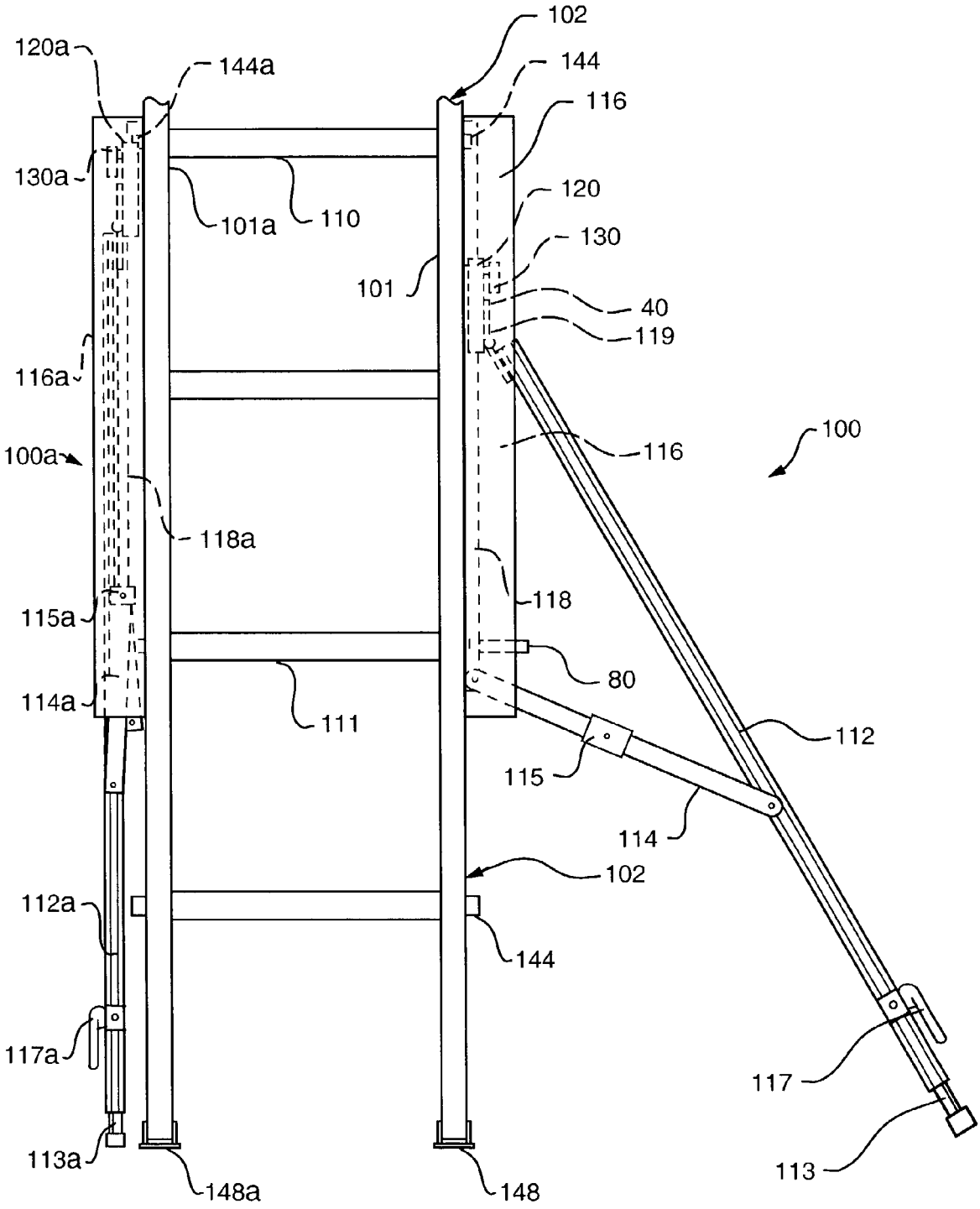
FIG. 12 is a front elevational view of the alternate embodiment of FIG. 11 showing an extension ladder with a stabilizer open on one side and closed on the other side of the extension ladder.

Referring now to FIG. 11, a front elevational view is shown of an alternate embodiment of a ladder stabilizer 100 for use with an extension ladder 102. The extension ladder stabilizers 100, 100*a* attach to each side rail 101, 101*a* of a lower section of the ladder 102 (an upper section is not shown). FIG. 12 is a front elevational view of the extension ladder 102 of FIG. 11 showing the ladder stabilizer 100 in an opened position on a first or right side of the ladder 102 and a second ladder stabilizer 100*a* in a closed position on a second or left side of the ladder 102.

Referring to FIG. 12, the extension ladder stabilizer 100 comprises a U-shaped guard 116 in which a channel 118, having a gear track 123 along its outer side length, which is the same as gear track 78 on channel 32 as shown in FIG. 2, is positioned and attached to the side rail 101 of the ladder 102 at an upper end of the U-shaped guard 116 by means of a first expansion insert 144 (FIG. 14) that is inserted into channel 118, into the side rail 101 of the ladder 102, into the step 110 and tightened in place. A second expansion insert 144*a* is inserted into channel 118*a* and U-shaped guard 116*a*, into the side rail 101*a* of the ladder 102, into step 111 and tightened in place. A slide lock bracket 120 (FIG. 13) is positioned on channel 118 for securing or locking the open and closed position of the ladder stabilizer 100. The slide lock bracket 120 is a self-locking bracket having a lever lock assembly 131 with an inwardly movable lever 130. A right angle portion of lever 130 protrudes into the gear track 123 along the outer side of the channel 118 and secures the slide lock bracket 120 to the channel 118. The lever 130 is the same as lever 72 in FIG. 10 which engages with gear track 78 in FIG. 2. A hinged connecting plate 40 as shown in FIG. 4 is attached to a lower portion of the slide lock bracket 120 below the lever 130. A first section 86 of the hinged connecting plate 40 is attached to the slide lock bracket 120 by a bolt 119 or other commonly known connecting means. A second section 88 is attached by another bolt or equivalent to an extending leg 112. The extending leg 112 is able to rotate about bolt 119 for positioning purposes and extends toward the surface on which the extension ladder 102 is placed at a distance away from the side of the ladder 102 thereby providing stabilization to the ladder 102. An arm 114 is attached between the extending leg 112 and the lower end of the channel 118 which limits the distance the extending leg 112 is moved away from the side of the ladder 102. A release clip 115 is positioned in the arm 114 to permit the arm 114 to fold-up when the ladder stabilizer 100 is closed-up as shown on the opposite side of ladder 102. As the slide lock bracket 120 moves up and down the channel 118, the extending leg 112 moves toward the ladder 102 and away from the ladder 102 to a preferred position. A lower extension section 113 of the extending leg 112 is adjustable.

Referring again to FIG. 11 and FIG. 12, the extension ladder stabilizer 100*a* on the left side of ladder 102 has the same components as the ladder stabilizer 100 on the right side of ladder 102. The letter "a" is added to the reference number to indicate similar stabilizer elements on the left side of the ladder 102 as are on the right side of ladder 102. Ladder stabilizer 100*a* is put into the closed position by raising the slide lock 120*a* along the channel 118*a* and adjusting release clip 115*a* so that the arm 114*a* folds-up allowing the extending leg 112*a* to move toward the side rail 101*a* of the ladder 102. If the lower extension section 113*a* was extended, then it has to be retracted to permit the ladder stabilizer 100*a* to close against the left side of the ladder 102 and to be within the U-shaped guard 116. The levers 117, 117*a* control the length of the lower extension sections 113, 113*a* respectively.

Figure 13:
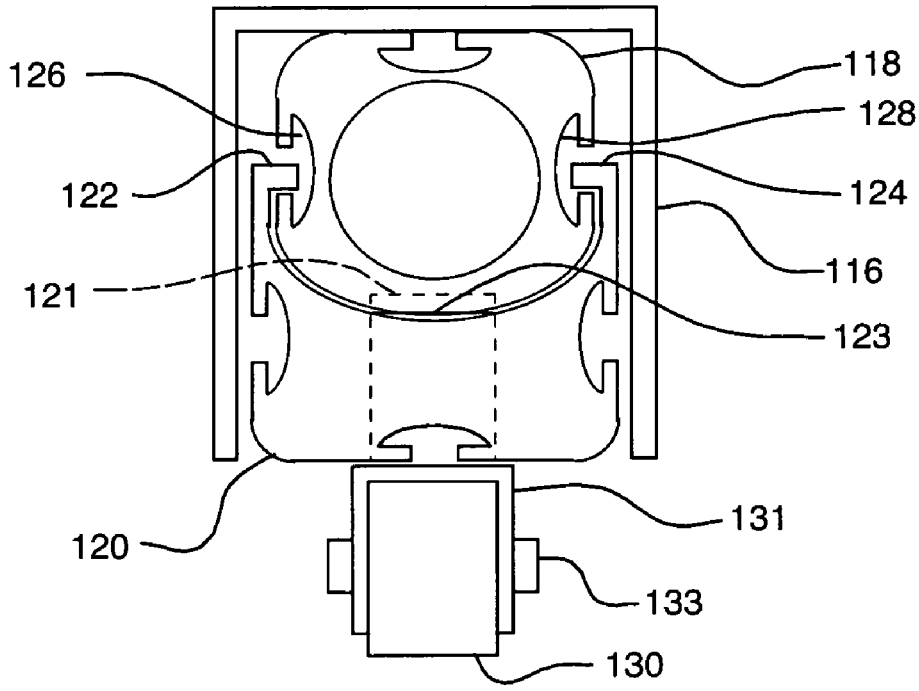
FIG. 13 is a top view of a slide lock of the extension ladder stabilizer.

Referring to FIG. 13, a top view of channel 118 attached within U-shaped guard 116 is shown with slide lock bracket 120 having right angle arms 122, 124 which protrude into slots 126, 128 respectively of the channel 118. The right angle arms 122, 124 keep the slide lock bracket 120 secured to channel 118 as it slides along channel 118. The lever 130 rotates about a pin 133, and when lever 130 is normally closed as shown in FIG. 13, it secures the slide lock bracket 120 along channel 118. The right angle portion of the lever 130 protrudes into the slide lock bracket 120 and presses against or meshes with the outer side of the channel 118 having the gear track 123. The channel 118 is provided with multiple slots such as slots 121, 126, 128 for receiving the lever 130, a bolt head, or right angle arms 122, 124 depending on the use of the channel 118 component. The slide lock bracket 120 is provided with an opening for receiving the right angle portion of the lever 130 that presses against or meshes with the gear track 123 0f the channel 118.

Figure 14:
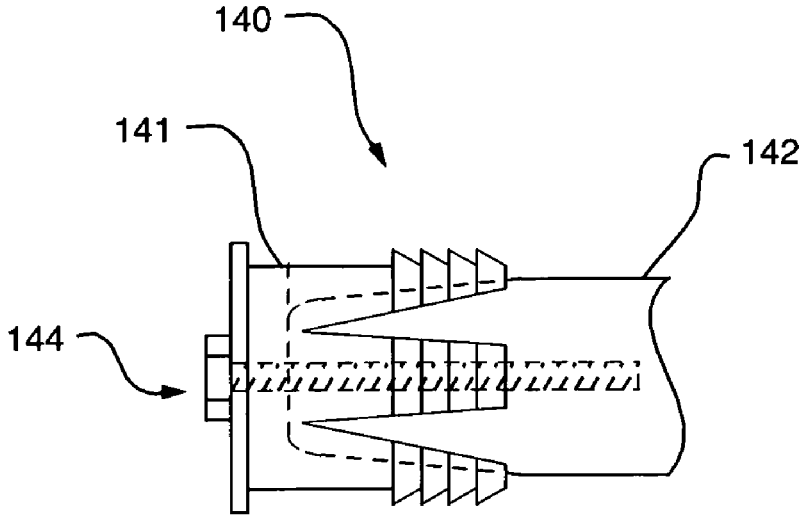
FIG. 14 is a side elevational view of an expansion insert for mounting a protective guard on sides of the extension ladder.

Referring to FIG. 14, a side elevational view of the expansion insert 144, 144*a* is shown for mounting the U-shaped guard 116 on the side of the ladder 102. The expansion insert comprises a bolt 144 inserted within two mating sections 141, 142 for pulling the sections 141, 142 together, when the bolt 144 is tightened thereby expanding section 141.

The preferred embodiment of the extension ladder stabilizers 100, 100*a* shown in FIG. 11 comprise elements with the following dimensions, but one of ordinary skill in the art will recognize that there are many variations to such dimensions that will work equally well. Each channel 118, 118*a* is 1½ inches wide by ½ inches deep by 30 inches long with a slot opening of ¾ inches wide. The extending legs 112, 112*a* are 1 inch in diameter and 55 inches long with the extending sections 113, 113*a* that extend another 15 inches. The spreader arm 114, 114*a* is 1 inch by ⅛ inch aluminum flat bar (FB) and 15 inches long.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An extension ladder stabilizer comprising:

a channel, capable of being attached to a side of a ladder, said channel comprises a gear track having rectangular teeth on an outer side running the length of said channel and said channel comprises a slot running the length of said channel on two opposite sides of said channel;

a self-locking slide bracket having a lever lock assembly positioned opposite said gear track of said channel and adapted to slide along said channel only when said lever lock assembly is released from said gear track and moved and locked at a preferred position;

said self-locking slide bracket comprises right angled arms which protrude into said slot on two opposite sides of said channel for retaining said self-locking slide bracket on said channel a rotatable connecting plate having a first section and a second section, said first section attaches to a lower portion of said self-locking slide bracket, and said second section rotates about said first section;

an extending leg having a first end attached to said second section of said rotatable connecting plate enabling said leg to rotate about said first section of said connecting plate; and a foldable arm having a first end attached to a lower end portion of said channel and a second end attached to a predetermined location on said extending leg.

2. The extension ladder stabilizer as recited in claim 1 wherein said lever lock assembly attached to said self-locking slide bracket comprises a lever for securing and moving said self-locking slide bracket along said gear track of said channel to said preferred position for optimum stabilization of said ladder.

3. The extension ladder stabilizer as recited in claim 1 wherein said extending leg comprises an extension section which extends from said extending leg for stabilizing said ladder.

4. The extension ladder as recited in claim 1 wherein said foldable arm comprises means for locking said arm into a fixed position for stabilizing said ladder.

5. The extension ladder stabilizer as recited in claim 1 wherein a U-shaped guard is positioned between a side of said ladder and said channel to protect said self-locking slide bracket and said extending leg when said extending leg is closed and adjacent to said ladder.

6. In combination:

an extension ladder comprising a plurality of steps positioned between a first side and a second side of said ladder;

each one of said plurality of steps having a first expansion insert placed into a first side of said ladder and into each of said plurality of steps and a second expansion insert placed into a second side of said ladder and into each of said plurality of steps;

a first ladder stabilizer attached to said first side of said extension ladder;

a second ladder stabilizer attached to said second side of said extension ladder;

said first ladder stabilizer and said second ladder stabilizer each comprising:

a channel attached to said side of said ladder having a gear track with rectangular teeth on an outer side running the length of said channel, and said channel comprises a slot running the length of said channel on two opposite sides of said channel;

a self-locking slide bracket having a lever lock assembly positioned opposite said gear track of said channel and adapted to slide along said channel only when said lever lock assembly is released from said gear track and moved and locked at a preferred position;

said self-locking slide bracket comprises right angled arms which protrude into said slot on two opposite sides of said channel for retaining said self-locking slide bracket on said channel;

a rotatable connecting plate having a first section and a second section, said first section attaches to a lower portion of said self-locking slide lock bracket and said second section rotates about said first section;

an extending leg having a first end attached to said second section of said rotatable connecting plate enabling a second end of said extending leg to be moved toward or away from said side of said ladder; and a foldable arm having a first end attached to a lower end of said channel and a second end attached to a predetermined location on said extending leg.

7. The combination as recited in claim 6 wherein said lever lock assembly attached to said self-locking slide bracket comprises lever for securing and moving said self-locking slide bracket along said gear track of said channel to said preferred position for optimum stabilization of said ladder.

8. The combination as recited in claim 6 wherein said extending leg comprises an extension section which extends from said extending leg for stabilizing said ladder.

9. The combination as recited in claim 6 wherein said foldable arm comprises means for locking said arm into a fixed position for stabilizing said ladder.

10. The combination as recited in claim 6 wherein a first U-shaped guard is positioned between a first side of said extension ladder and said channel of said first ladder stabilizer, and a second U-shaped guard is positioned between a second side of said ladder and said channel of said second ladder stabilizer.

* * * * *